US008079553B1

(12) United States Patent
Martin

(10) Patent No.: US 8,079,553 B1
(45) Date of Patent: Dec. 20, 2011

(54) KEYBOARD SUPPORTING TRAY AND ARM RESTS FOR CONVENTIONAL OPEN ARM OFFICE CHAIRS

(76) Inventor: Steve Martin, Salisbury, NC (US)

( * ) Notice: Subject to any disclaimer, the term of this patent is extended or adjusted under 35 U.S.C. 154(b) by 0 days.

(21) Appl. No.: 11/485,070

(22) Filed: Jul. 11, 2006

(51) Int. Cl.
*A47B 39/00* (2006.01)
*A47B 83/02* (2006.01)

(52) U.S. Cl. ..... 248/145; 297/160; 297/161; 297/173; 297/153; 297/155; 108/17; 108/65; 108/135; 248/346.01; 248/229.23; 248/231.51; 248/918; 248/346.03; 248/346.3; 248/682; 248/687; 248/118; 248/118.1; 248/229.14; 248/349.1

(58) Field of Classification Search ..... 248/346.01, 248/229.23, 231.51, 918, 346.03, 346.3, 248/682, 687, 118, 118.1, 229.14, 349.1; 361/680; 108/17, 65, 159.11, 157.18, 77, 108/135; 297/160, 161, 173, 153, 155, 145
See application file for complete search history.

(56) References Cited

U.S. PATENT DOCUMENTS

| | | | | | |
|---|---|---|---|---|---|
| 975,755 | A | | 11/1910 | Eyles | |
| 3,121,591 | A | * | 2/1964 | Micciche | 297/153 |
| 3,606,449 | A | * | 9/1971 | Whybrew et al. | 297/115 |
| 4,591,206 | A | * | 5/1986 | Pribble | 297/148 |
| 4,668,010 | A | * | 5/1987 | Fujiwara | 297/150 |
| 4,846,432 | A | * | 7/1989 | Skewis | 248/235 |
| 5,022,706 | A | * | 6/1991 | Bryan | 297/162 |
| 5,281,001 | A | | 1/1994 | Bergsten et al. | 297/411.24 |
| 5,369,805 | A | | 12/1994 | Bergsten et al. | 297/411.35 |
| 5,393,124 | A | | 2/1995 | Neil | 297/411.35 |
| 5,407,249 | A | | 4/1995 | Bonutti | 297/411.35 |
| 5,478,034 | A | | 12/1995 | Cunningham et al. | 248/118.5 |
| 5,597,207 | A | | 1/1997 | Bergsten et al. | 297/411.35 |
| 5,612,718 | A | | 3/1997 | Bryan | 345/168 |
| 5,653,499 | A | | 8/1997 | Goodall | 297/170 |
| 5,709,365 | A | * | 1/1998 | Howard | 248/454 |
| 5,816,649 | A | * | 10/1998 | Shields | 297/162 |
| 5,887,940 | A | | 3/1999 | Anderson et al. | 297/135 |
| 6,027,165 | A | * | 2/2000 | Adkins | 297/188.18 |
| 6,045,179 | A | * | 4/2000 | Harrison | 297/188.2 |
| 6,062,640 | A | | 5/2000 | Stahl | 297/135 |
| 6,123,387 | A | | 9/2000 | Kelly | 297/188.18 |
| 6,264,150 | B1 | | 7/2001 | Kolenchuk | 248/118 |
| 6,264,272 | B1 | * | 7/2001 | Jones et al. | 297/173 |
| 6,276,646 | B1 | * | 8/2001 | Gaba | 248/118 |
| 6,352,303 | B1 | | 3/2002 | Hope | 297/188.18 |
| 6,354,658 | B1 | * | 3/2002 | Sher et al. | 297/188.14 |

(Continued)

OTHER PUBLICATIONS

Ergo-Items.com; information from the internet, copyright 2005.

(Continued)

*Primary Examiner* — Nkeisha Smith
(74) *Attorney, Agent, or Firm* — Hammer & Associates, P.C.

(57) ABSTRACT

A peripheral device support assembly. The peripheral device support assembly includes two detachable armrest and support tray adapted to be attached to each arm of an office chair. The detachable armrest and support tray includes a mount for securing the armrest support unit to a chair arm and a first portion hingedly attached to the mount for allowing the first portion to swivel in relation to the mount. The detachable armrest and support tray also includes a second portion pivotally connected to the second portion such that the first portion folds back over a second portion for storage. A tray spans the distance between the second portion of each detachable armrest and support tray to provide additional workspace.

15 Claims, 8 Drawing Sheets

U.S. PATENT DOCUMENTS

| | | | | |
|---|---|---|---|---|
| 6,471,164 | B2 * | 10/2002 | DiOrio | 248/118 |
| 6,755,137 | B2 | 6/2004 | Wentz | 108/44 |
| 6,843,534 | B2 | 1/2005 | Lee et al. | 297/411.35 |
| 6,935,683 | B1 * | 8/2005 | Brown | 297/188.2 |
| 7,367,618 | B2 * | 5/2008 | Rossini | 297/188.18 |
| 7,862,111 | B2 * | 1/2011 | Steenson | 297/161 |
| 2002/0017594 | A1 * | 2/2002 | DiOrio, Jr. | 248/118 |
| 2002/0060277 | A1 * | 5/2002 | Tsai et al. | 248/118 |

OTHER PUBLICATIONS

Southwest Medical Online; information from the internet, copyright 2006.

Therafin Corporation; information from the internet; undated, possible prior art.

* cited by examiner

KEYBOARD SUPPORTING TRAY AND ARM RESTS FOR CONVENTIONAL OPEN ARM OFFICE CHAIRS

BACKGROUND OF THE INVENTION

The present invention relates generally to ergonomic peripheral device support assemblies, and more specifically to an ergonomic keyboard and mouse pad supporting tray and arm rest for use with conventional open arm office chairs.

The typical computer mouse rests on a desk adjacent a computer monitor. The keyboard may also lie next to the monitor or alternatively may be housed in front of the keyboard. Often this arrangement causes a user to hold his wrist in an angled position that has been shown to cause carpal tunnel and other health ailments in users who sit at their computer for hours at a time.

To alleviate this problem, many users place the keyboard in a pull out tray that is positioned near their lap. However, the mouse is often still at another location. As such, the user must still position his wrist at an awkward angle when using the mouse. In addition, the mouse is not convenient to the keyboard in this position.

Thus there remains a need in the art for an improved keyboard support tray and arm rests for conventional open arm office chairs. There also remains a need for a detachable armrest and support tray that provides hinged armrests that can fold and swivel to positions out of the way of the user, can be retrofitted onto existing chairs, is easy to install, and provides arm rest and work surfaces for the use of both a keyboard or laptop computer, mouse, or other peripheral devices.

SUMMARY OF THE INVENTION

The present invention addresses one or more of those needs in the art by providing a detachable armrest and support tray for supporting a peripheral device including a first portion having a mount adapted to be mounted onto an armrest in a defined configuration for securing the first portion to the armrest; and a second portion pivotally attached to the first portion such that the second portion may pivot from a first position over the first portion for storage to a second position in which the first and second portions are generally aligned with the armrest when the mount is mounted in the defined configuration.

The mount may be selected from the group consisting of clamps, hook and loop fasteners, and combinations thereof. The second portion preferably has a surface that is sized and configured to accommodate a mouse pad. The first portion may be attached to the mount by a tether. The detachable armrest and support tray may be made of a material selected from the group consisting of plastics, wood, metals, and combinations thereof.

Typically, there are two detachable armrests.

A preferred embodiment includes a tray sized to span a distance between two detachable armrest and support trays mounted in the defined configuration on armrests of a chair for providing additional work area. Preferably, the tray is sized and configured to hold a computer keyboard. It can also be sized and configured to hold a laptop computer. Preferably, the tray has a textured surface to inhibit sliding of items placed on the tray. If the tray has a proximal end and a distal end, the tray may slope downward from the distal end to the proximal end.

The first portion may have padding positioned to provide comfort to a user. The second portion may be attached to the first portion by a hinge.

These and other aspects of the present invention will become apparent to those skilled in the art after a reading of the following description of the preferred embodiment when considered with the drawings.

DESCRIPTION OF THE PREFERRED EMBODIMENTS

Figure 1:
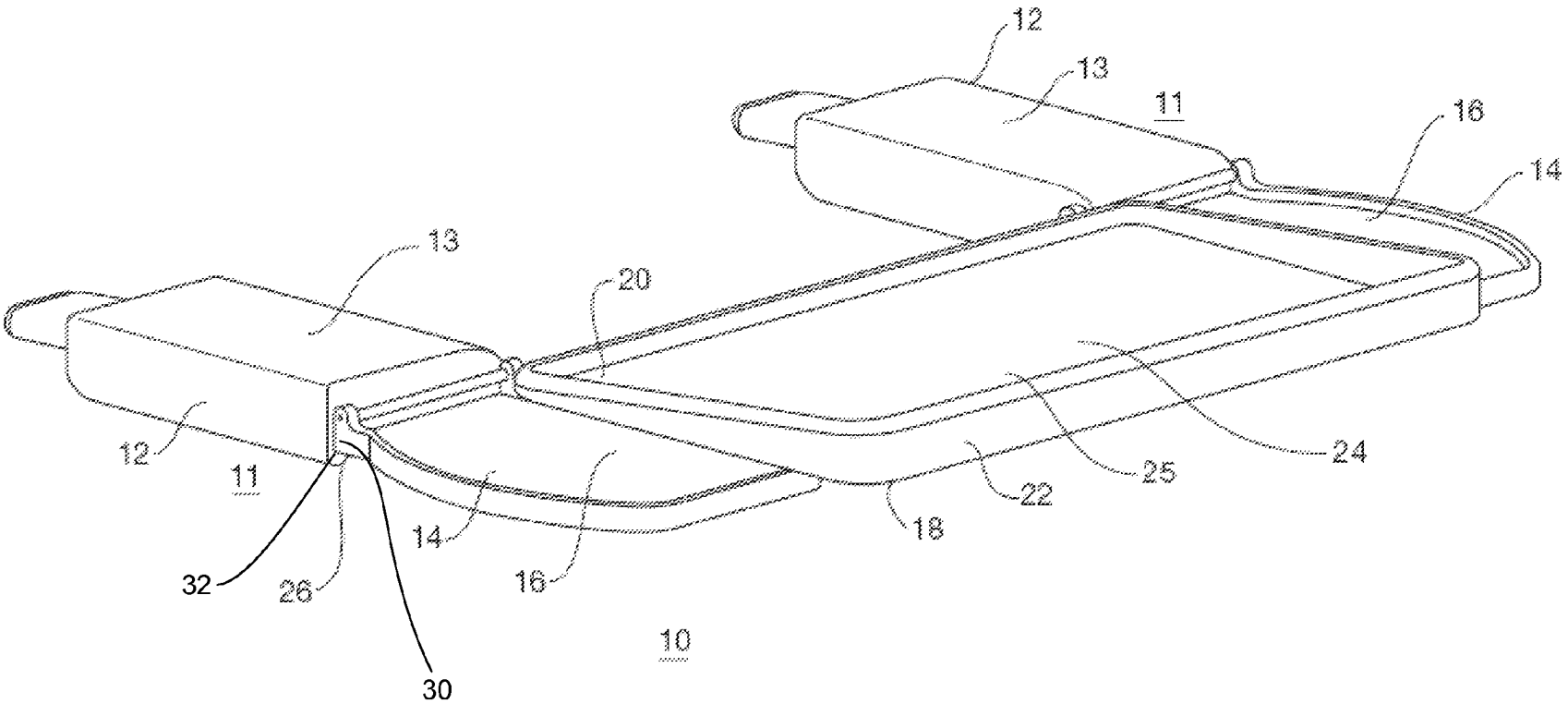
FIG. 1 is a perspective view of an embodiment of a peripheral device support assembly of the present invention.

FIG. 1 shows an embodiment of a peripheral device support assembly 10. The peripheral device support assembly 10 is preferably made of ABS plastic. However, other materials including other plastics, metal, wood, and combinations thereof may be used.

Figure 6:
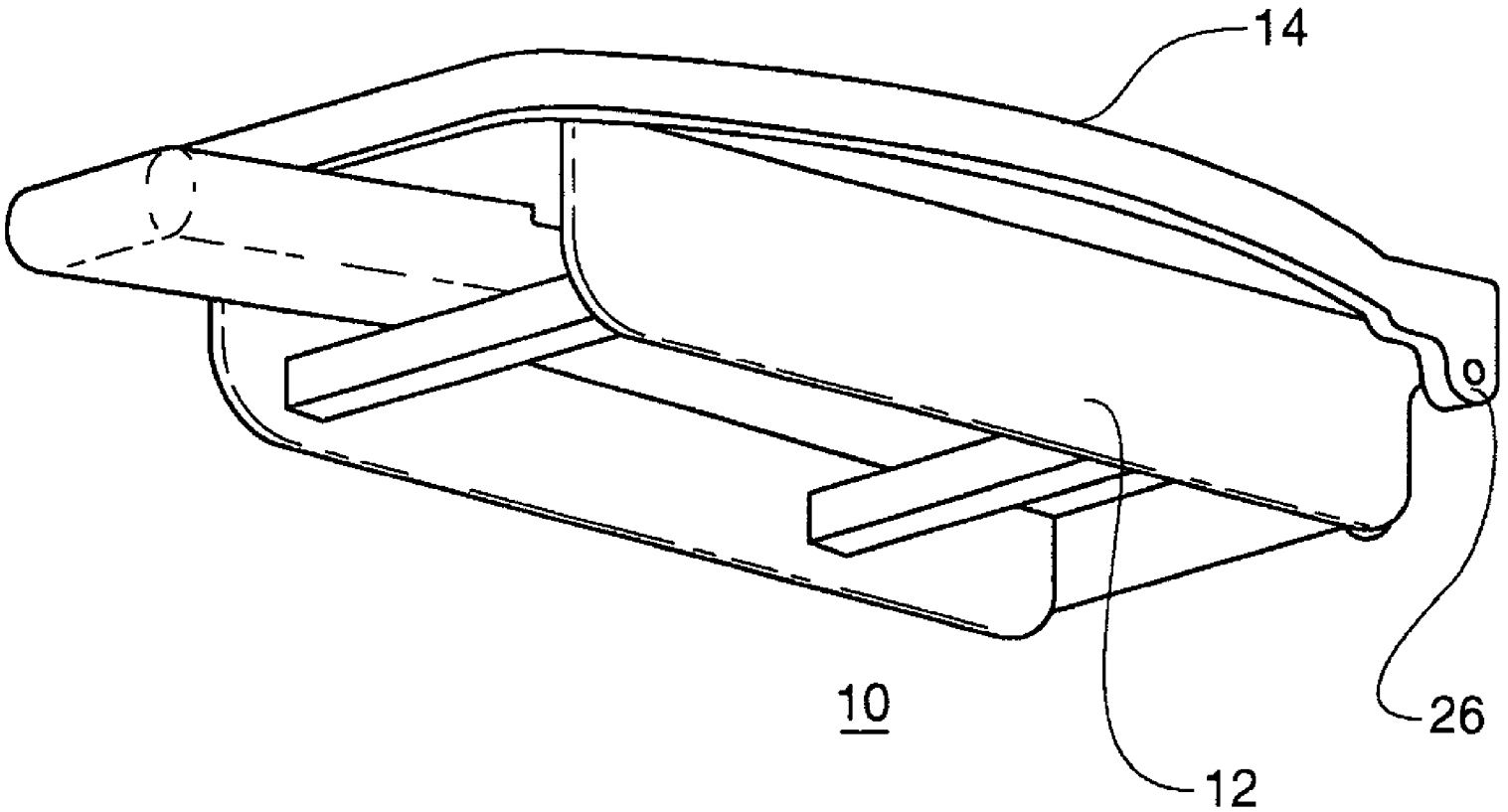
FIG. 6 is a bottom perspective view of the detachable armrest and support tray of FIG. 1 in a storage position.

The peripheral device support assembly 10 includes two detachable armrest and support trays 11. The detachable armrest and support tray 11 includes a first portion 12 and a second portion 14 that is pivotally connected to the first portion 12 by a hinge 26. As seen in FIG. 1, the second portion has a butt-like protrusion 30. The protrusion 30 abuts a forward edge 32 of the first portion when the second portion is extended for use. This abutment limits the travel of the second portion so that the second portion stops generally parallel and coplanar with the first portion. As seen in FIG. 6, the second portion 14 may fold over the first portion 12 for storage.

In other embodiments, the second portion 14 may be connected to the first portion 12 by other connectors such as clamps, glue, welding, and any other connector. Alternatively, the first portion 12 and the second portion 14 may be molded as one piece.

As seen in FIG. 1, the first portion 12 is covered with foam rubber padding 13 for the comfort of a user. Other types of padding may also be used. The second portion 14 may include a surface 16 that is sized and configured to accommodate a computer mouse or other peripheral device. The surface 16 may be covered with a material to form a computer mouse pad on the surface 16. Alternatively, the surface 16 may also be used for writing and other such activities.

In an embodiment, two detachable armrest and support trays 11 may be used. A tray 18 may span between each detachable armrest and support tray 11. The tray 18 has a work surface 25 that is sized and configured to accommodate a laptop computer, keyboard, or other peripheral device. The tray 18 may also provide writing or other workspace. The tray 18 is also sized and configured to span the distance between two detachable armrest and support trays 11. The tray 18 may rest on the second portion 14 of each detachable armrest and support tray 11 or the tray 18 may be mounted to the second portion 14 using clamps, tape, hoop and loop fasteners, or any other suitable mount. As shown, a ridge on top of the portion 14 at the inside edge extends into a groove on the bottom of the edge of tray 18, inhibiting left-to-right shifting of the position of tray 18.

Figure 2:
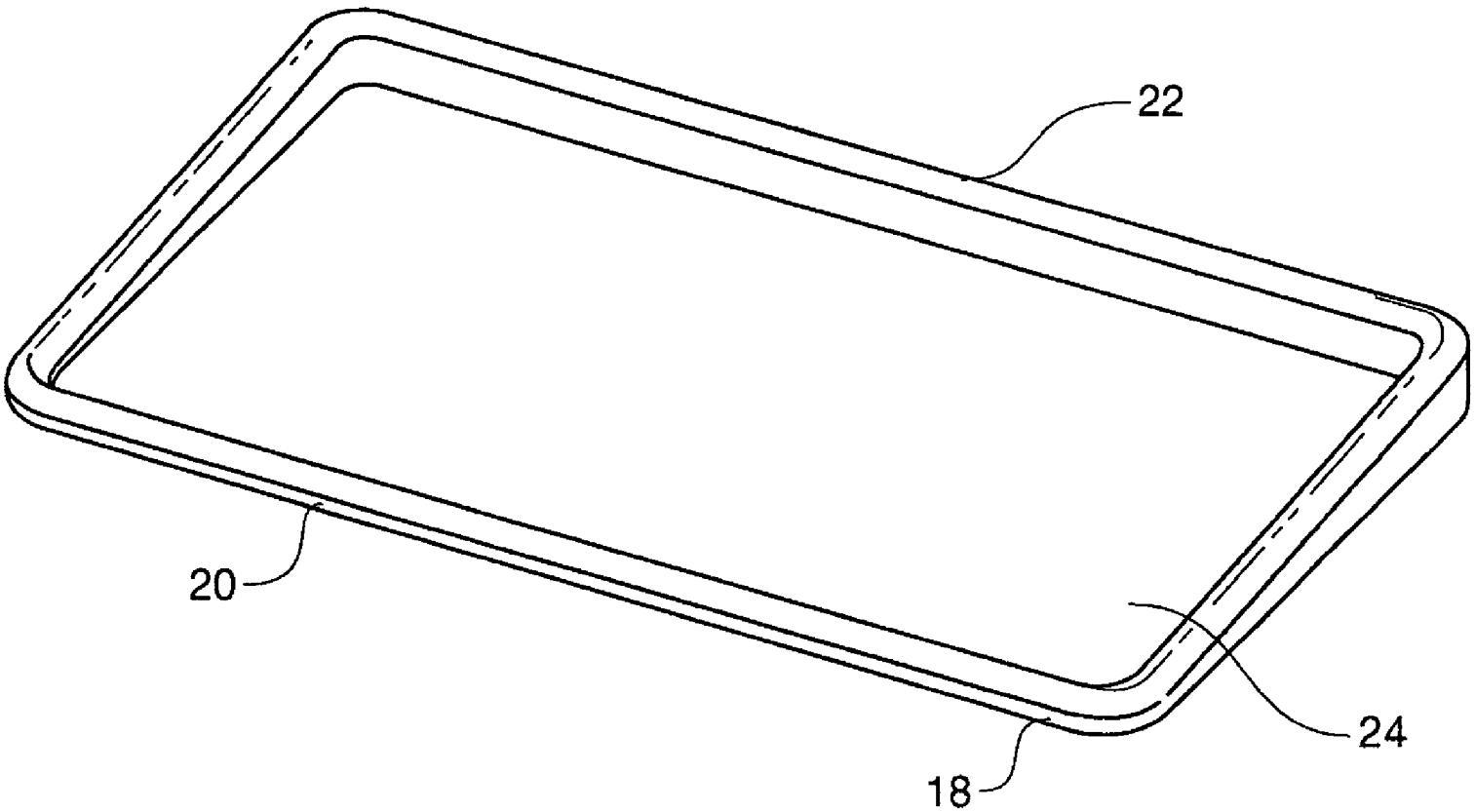
FIG. 2 is a perspective view of an embodiment of the tray constructed according to the present invention.

As seen in FIG. 2, the tray 18 has a proximal end 20 and a distal end 22. Preferably, the edge of the tray is sloped downward from the distal end 22 to the proximal end 20. Alternatively, the tray may be flat or may be sloped downward from the proximal end 22 to the distal end 20. Also, a textured lining 24 may be applied to the work surface 25 to prevent materials from sliding down the slope from the second end 22 to the first end 20. Preferably, the tray's work surface 25 is formed with a textured surface. Alternatively the tray 18 may have a smooth surface.

Figure 3:
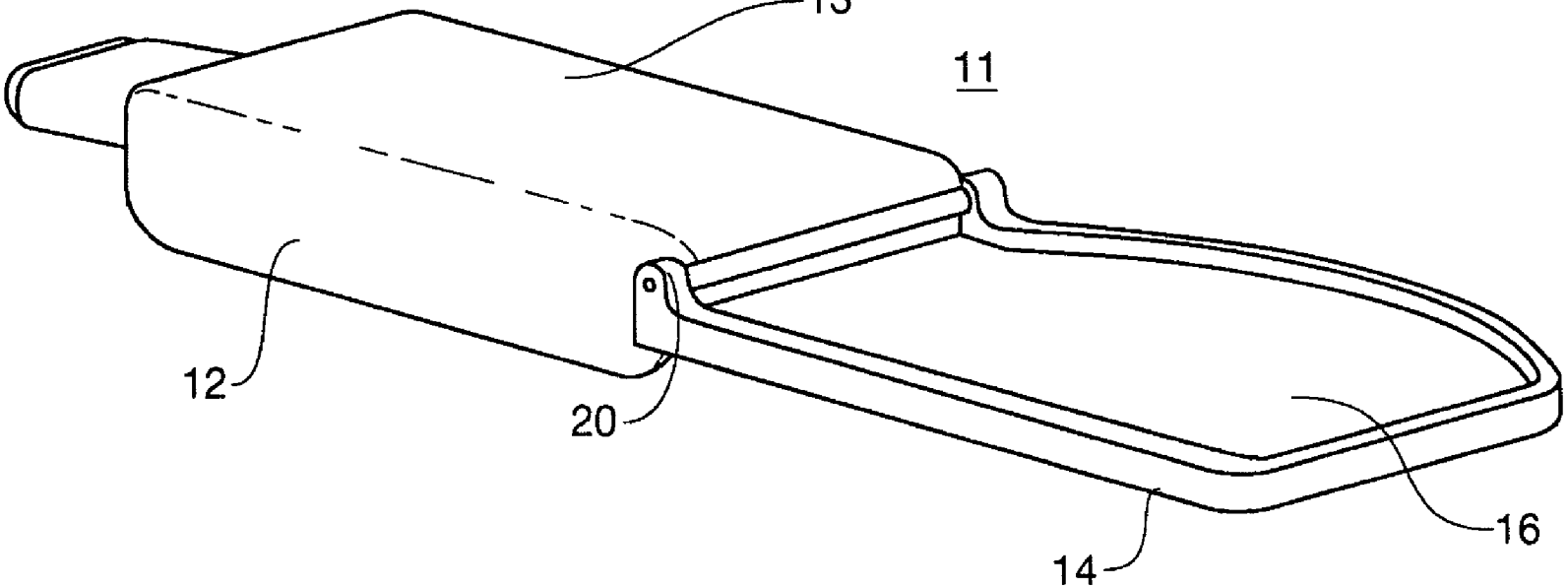
FIG. 3 is a perspective view of a left oriented detachable armrest and support trays of FIG. 1.
Figure 4:
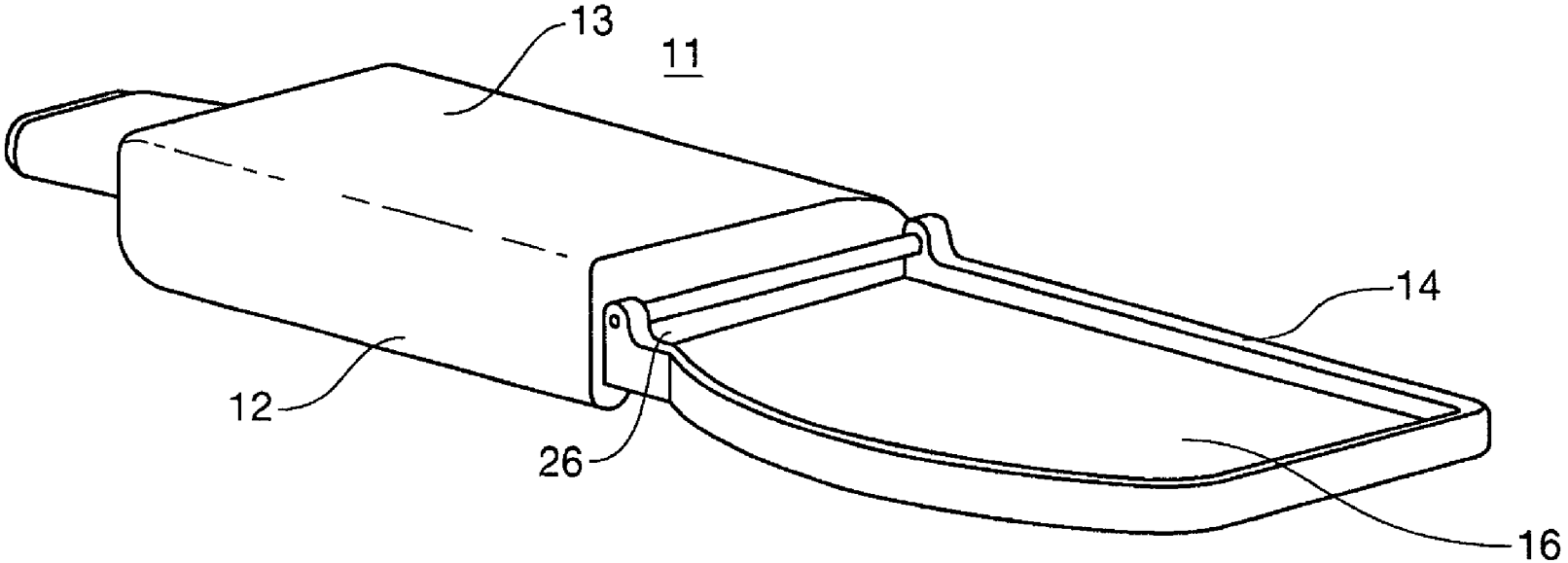
FIG. 4 is a perspective view of a right oriented detachable armrest and support tray of FIG. 1.

FIG. 3 is a perspective view of a left-hand oriented detachable armrest and support tray 11. FIG. 4 is a perspective view of a right-hand oriented detachable armrest and support tray. The second portion 14 of each detachable armrest and support tray 11 is shaped such that the second portion 14 is straight on the interior, so that a user's path to the seat is unencumbered by the second portion 14. In other embodiments, the detachable armrest and support tray may not have a specific orientation.

The second portion 14 is sized and configured to provide space for a mouse or other peripheral device. However, it is not necessary to make the second portion a specific shape. Any shape such as a circle, rectangle, square, triangle, or other shape is sufficient so long as it provides work space for the user. A mouse pad may be mounted permanently or temporarily to the surface of the second portion 14.

Figure 5:
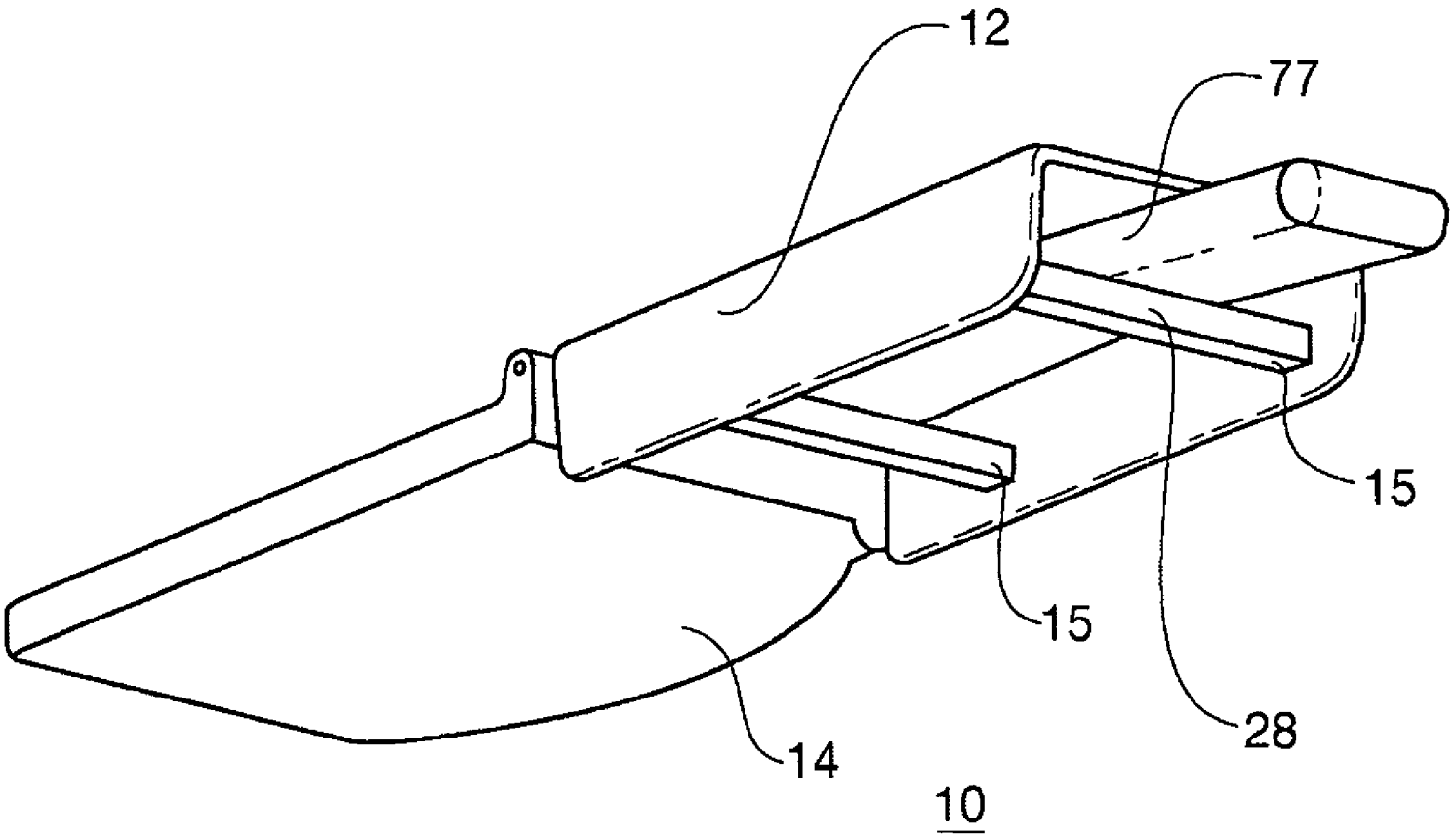
FIG. 5 is a bottom perspective view of the detachable armrest and support tray of FIG. 1.

FIG. 5 is a bottom perspective view of the first embodiment of the detachable armrest and support tray 11. The detachable armrest and support tray 11 includes a first portion 12 and a second portion 14. The first portion 12 may be attached to an existing armrest using a mount 28 such as clamps, hook and loop fasteners, and any other mount. As seen in FIG. 5, the first portion 12 is held in place by a mount 28. Preferably, the mount 28 includes two mounting bars 15. The bars 15 are sized and configured to fit underneath the first portion 12 between the two downward-extending sides of the portion 12. Screws are inserted through the top 11 into threaded inserts in the mounting bars 15. This allows adjustment for different thickness in armrests.

To install a detachable armrest and support tray 11, a user places the first portion 12 over an armrest 77, positions the bars 15 underneath the armrest, aligns the screw holes in the ends of the bar with the screw holes in the side of the first portion 12, and inserts screws through the holes in the first portion 12 and into the screw holes in the ends of the bar.

FIG. 6 is a bottom perspective view of the first embodiment of a detachable armrest and support tray 11 in a folded position. In an embodiment, the detachable armrest and support tray 11 includes a first portion 12 and a second portion 14 that is hingedly connected to the first portion 12 so that the second portion 14 may fold over the first portion 12 for storage. The second portion 14 is connected to the first portion 12 by a hinge 26. Other connectors or configurations that enable the second portion 14 to fold over the first portion 12 may be used in lieu of a hinge 26.

Figure 7:
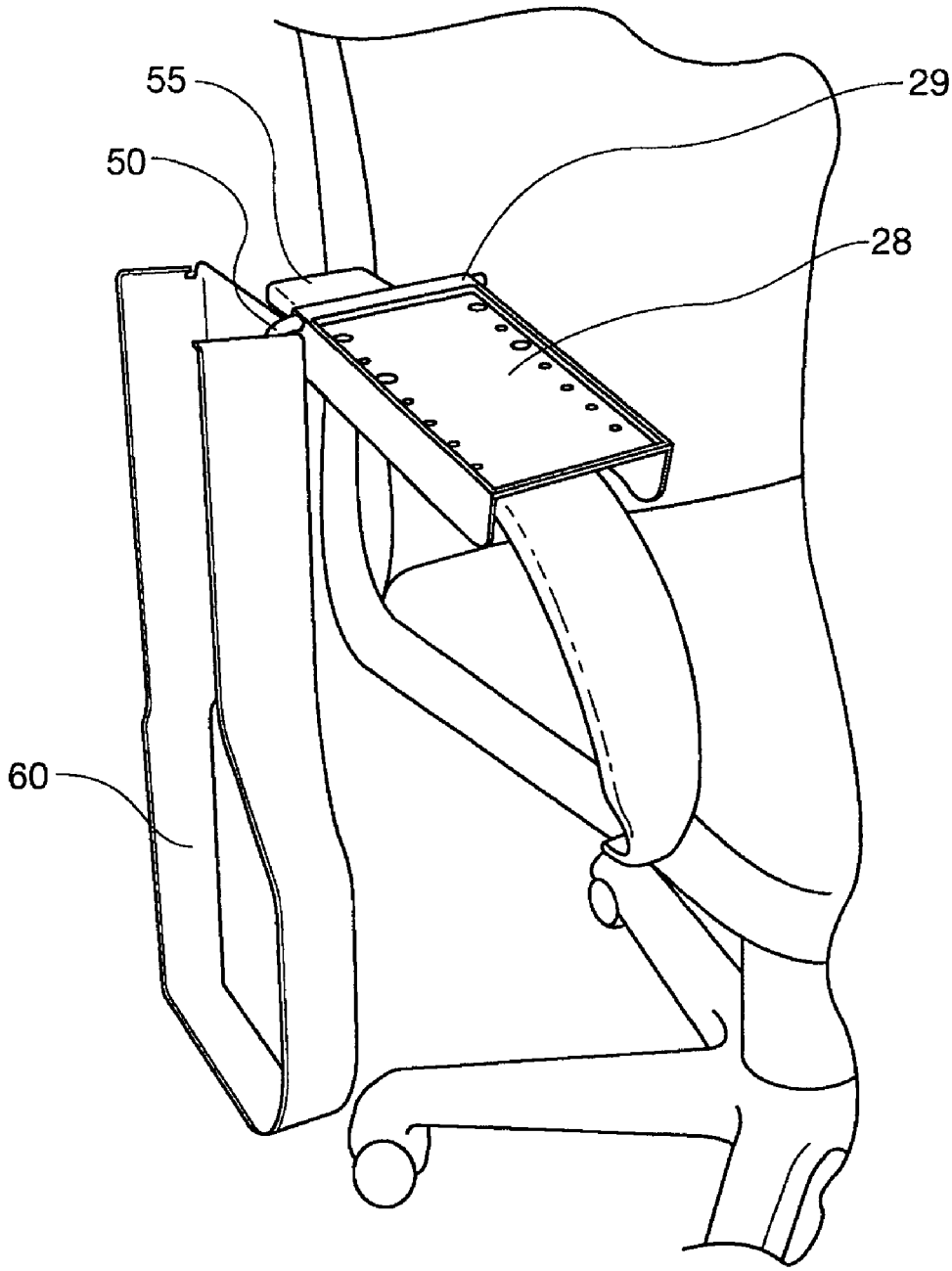
FIG. 7 is a perspective view of a second embodiment of a detachable armrest and support tray.

FIG. 7 is a perspective view of a second embodiment of a detachable armrest and support tray 55 including a molded portion 60 that is attached to the mount 28 in such a way as to allow the molded portion 60 to swivel in relation to the affixed portion 29 so that the detachable armrest and support tray 11 may be stored to the side of a chair while the portion 29 remains attached to an existing armrest. The tray 55 may be attached to the mount 28 by a tether 50. The tether 50 may be a hinge pin, bungee cord, or any other flexible material that allows for two attached items to move in relation to one another. The molded portion 55 may swivel latitudinally and longitudinally in relation to the mount 28 so that the molded portion 60 rests to the side of the mount 28.

In the view of FIG. 7, the tether 50 is an L-shaped pivot, allowing pivoting about each leg of the L. One leg is in the rear of the portion 29 and the other is in the outside edge of the portion 60. To mount the portion 60 on the portion 29 so as to make a useable surface, one rotates the portion 60 from the view of FIG. 7 forwardly, causing rotation about the leg of the L in the rear of the portion 29. This continues until the portion 60 is rotated through about 180° from the position shown in FIG. 7. Then, the portion 60 is rotated about the leg of the L in the portion 60, toward the seating surface of the chair, until the lower side flanges of portion 60 are above the spaces on either side of portion 29. Then the portion 60 is rotated about the leg of the L in the portion 29 downwardly onto the portion 29, with the sides of portion 60 straddling the portion 29.

Figure 8:
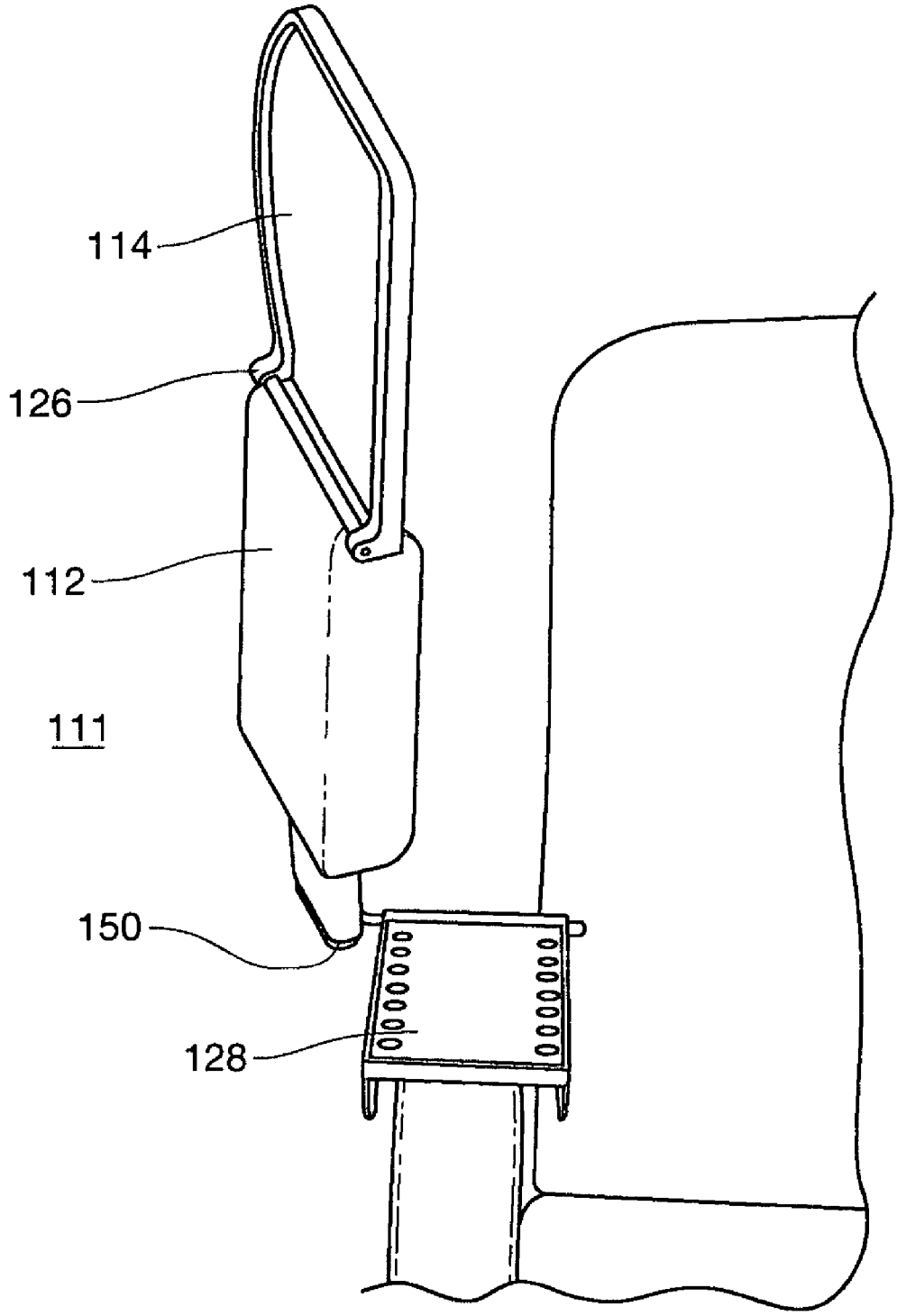
FIG. 8 is a perspective view of a third embodiment of the present invention.

FIG. 8 is a perspective view of a third embodiment of a detachable armrest and support tray 111. The detachable armrest and support tray 111 includes a first portion 112 and a second portion 114 that is pivotally attached to the first portion 112 by a hinge 126 so that the second portion 114 may fold over the second portion 112 for storage. The first portion 112 is attached to the mount 128 by a tether 150 so that the mount 128 may swivel in relation to the mount 128 for storage.

To store the detachable armrest and support tray 111 a user may fold the second portion 114 over the first portion 112. Then the user may lift the first portion upward, turn the first portion counterclockwise one quarter turn, and then turn the first portion clockwise a half turn.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A peripheral device support assembly comprising:

two detachable armrest and support trays;

each of said detachable armrest and support trays including:

a first portion being adapted to be removably attached to an armrest of a chair;

said first portion including a mount adapted for holding said first portion in place on said armrest of a chair;

said mount including:

a plurality of mounting bars being adapted to fit underneath said first portion between two downward-extending sides of said first portion, where said plurality of mounting bars being for securing said armrest of a chair between said mounting bars and said first portion;

a second portion being connected to said first portion by a hinge said hinge including an L-shaped protrusion formed at outer ends of a perimeter of the second portion, an upper portion of said L-shaped protrusions connected by a horizontal attachment bar, whereby, said second portion extending parallel to said first portion in an extended position and folding over said first portion in a storage position;

a surface on each of said second portions sized to accommodate a computer mouse or other peripheral device in said extended position; and each of said second portions having a straight inner edge and a curved outer edge, said straight inner edge allowing a user's path to said chair to be unencumbered by said second portion, said curved outer edge providing more space on said second portion for said surface;

a tray spanning a distance between each of said detachable armrest and support trays;

said tray including a work surface sized to accommodate a laptop computer, a keyboard, or other peripheral device; and said tray being adapted to rest on said second portions when in said extended position.

2. The peripheral device support assembly of claim 1 wherein said mounting bars being adapted to be screwed into said two downward-extending sides of said first portion beneath said armrest.

3. The peripheral device support assembly of claim 1 wherein said two downward-extending sides of each of said first portions creating a cavity underneath each of said first portions adapted to receive said armrest.

4. The peripheral device support assembly of claim 1 wherein said mount including two mounting bars.

5. The peripheral device support assembly of claim 1 whereby, when said detachable armrest and support trays being attached to the armrests of a chair, a user sitting in the chair between said armrests can extend the second portions from said storage position to said extended position and place said tray on said second portions to support a keyboard, laptop or other peripheral device, and later, remove said tray from said second portions, return said second portions to said storage position, and exit the chair.

6. The peripheral device support assembly of claim 1 wherein said tray including a proximal end and a distal end, where said tray being sloped downward from said distal end to said proximal end.

7. The peripheral device support assembly of claim 1 wherein said first portions including padding positioned to provide comfort to a user.

8. The peripheral device support assembly of claim 1 where said work surface including a textured lining adapted to prevent materials from sliding.

9. The peripheral device support assembly of claim 1 wherein said two detachable armrest and support trays further including a mouse pad mounted to each of said second portions.

10. The peripheral device support assembly of claim 1 wherein said surface on said second portions being recessed where said perimeter is a raised edge completely around said surface.

11. The peripheral device support assembly of claim 1 wherein said work surface on said tray being recessed where said work surface having a raised edge completely around said work surface.

12. The peripheral device support assembly of claim 1 being made of a material selected from a group consisting of plastics, wood, metals, and combinations thereof.

13. The peripheral device support assembly of claim 1 wherein:

said second portion having a pivot mount defining a pivot axis at said horizontal attachment bar;

said second portion being pivotally attached to said first portion to enable pivoting movement of said second portion about said pivot axis; and each L-shaped protrusion having a bottom being rigidly a part of said second portion and being positioned offset from said pivot axis, such that said second portion may pivot from said extended position substantially 180 degrees to said storage position;

wherein, when in said storage position, said second portion being parallel to said first portion and substantially 180 degrees from said extended position; and wherein, when in said extended position, said bottom abuts a forward edge of said first portion to limit pivoting travel of said second portion so that said extended position of said second portion being generally parallel and coplanar with said first portion.

14. A peripheral device support assembly comprising:

two detachable armrest and support trays;

each of said detachable armrest and support trays including:

a first portion being adapted to be removably attached to an armrest of a chair;

said first portion including a mount adapted for holding said first portion in place on said armrest of a chair;

said mount including:

a plurality of mounting bars being adapted to fit underneath said first portion between two downward-extending sides of said first portion, where said plurality of mounting bars being for securing said armrest of a chair between said mounting bars and said first portion;

a second portion being connected to said first portion by a hinge, said hinge including an L-shaped protrusion formed at outer ends of a perimeter of the second portion, an upper portion of said L-shaped protrusions connected by a horizontal attachment bar, whereby, said second portion extending parallel to said first portion in an extended position and folding over said first portion in a storage position;

said second portion having a pivot mount defining a pivot axis at said horizontal attachment bar;

said second portion being pivotally attached to said first portion to enable pivoting movement of said second portion about said pivot axis; and each L-shaped protrusion having a bottom being rigidly a part of said second portion and being positioned offset from said pivot axis, such that said second portion may pivot from said extended position substantially 180 degrees to said storage position;

wherein, when in said storage position, said second portion being parallel to said first portion and substantially 180 degrees from said extended position; and wherein, when in said extended position, said bottom abuts a forward edge of said first portion to limit pivoting travel of said second portion so that said extended position of said second portion being generally parallel and coplanar with said first portion;

a surface on each of said second portions sized to accommodate a computer mouse or other peripheral device in said extended position; and each of said second portions having a straight inner edge and a curved outer edge, said straight inner edge allowing a user's path to said chair to be unencumbered by said second portion, said curved outer edge providing more space on said second portion for said surface;

a tray spanning a distance between each of said detachable armrest and support trays;

said tray including a work surface sized to accommodate a laptop computer, a keyboard, or other peripheral device; and said tray being adapted to rest on said second portions when in said extended position.

15. A peripheral device support assembly comprising:

two detachable armrest and support trays;

each of said detachable armrest and support trays including:

a first portion being adapted to be removably attached to an armrest of a chair;

said first portion including a mount adapted for holding said first portion in place on said armrest of a chair;

said mount including:

a plurality of mounting bars being adapted to fit underneath said first portion between two downward-extending sides of said first portion, where said plurality of mounting bars being for securing said armrest of a chair between said mounting bars and said first portion;

a second portion being connected to said first portion by a hinge, said hinge including an L-shaped protrusion formed at outer ends of a perimeter of the second portion, an upper portion of said L-shaped protrusions connected by a horizontal attachment bar, whereby, said second portion extending parallel to said first portion in an extended position and folding over said first portion in a storage position;

a surface on each of said second portions sized to accommodate a computer mouse or other peripheral device in said extended position; and each of said second portions having a straight inner edge and a curved outer edge, said straight inner edge allowing a user's path to said chair to be unencumbered by said second portion, said curved outer edge providing more space on said second portion for said surface;

a tray spanning a distance between each of said detachable armrest and support trays;

said tray including a work surface sized to accommodate a laptop computer, a keyboard, or other peripheral device;

said work surface on said tray being recessed where said work surface having a raised edge completely around said work surface; and said tray being adapted to rest on said second portions when in said extended position.

* * * * *